US007682489B2

(12) United States Patent
Odmark et al.

(10) Patent No.: US 7,682,489 B2
(45) Date of Patent: Mar. 23, 2010

(54) TWIN-WIRE PRESS

(75) Inventors: Leif Odmark, Matfors (SE); Peter Svedberg, Alnö (SE); Anders Löfstrand, Sundsvall (SE); Hans Lövgren, Sundsvall (SE)

(73) Assignee: Metso Paper, Inc. (SE)

( * ) Notice: Subject to any disclaimer, the term of this patent is extended or adjusted under 35 U.S.C. 154(b) by 481 days.

(21) Appl. No.: 11/629,424

(22) PCT Filed: Jun. 3, 2005

(86) PCT No.: PCT/SE2005/000850

§ 371 (c)(1),
(2), (4) Date: Dec. 13, 2006

(87) PCT Pub. No.: WO2005/121444

PCT Pub. Date: Dec. 22, 2005

(65) Prior Publication Data

US 2008/0277086 A1 Nov. 13, 2008

(30) Foreign Application Priority Data

Jun. 14, 2004 (SE) ..... 0401510

(51) Int. Cl.
*D21H 11/00* (2006.01)
*D21F 27/00* (2006.01)

(52) U.S. Cl. ..... 162/313; 162/361; 162/303; 162/305; 162/203

(58) Field of Classification Search ..... 162/313, 162/361, 303, 305, 360.2, 200, 203
See application file for complete search history.

(56) References Cited

U.S. PATENT DOCUMENTS

| | | | | |
|---|---|---|---|---|
| 3,994,774 | A | 11/1976 | Halme et al. | |
| 4,138,316 | A | 2/1979 | Kessler et al. | |
| 4,584,936 | A | 4/1986 | Crandall et al. | |
| 5,783,054 | A * | 7/1998 | Raguse et al. | 204/403.08 |
| 6,003,684 | A | 12/1999 | Eickhoff et al. | |
| 6,338,773 | B1 | 1/2002 | Sbaschnigg et al. | |
| 7,051,882 | B2 * | 5/2006 | Odmark et al. | 210/401 |
| 2007/0187058 | A1 * | 8/2007 | Lovgren | 162/303 |

FOREIGN PATENT DOCUMENTS

| | | |
|---|---|---|
| EP | 1 416 085 A1 | 5/2004 |

OTHER PUBLICATIONS

Document marked D4 filed in an opposition against the corresponding patent in Austria said by the opposer to constitute Erection, Operating and Maintenance Instructions—May 1995, allegedly said to have been built and used in Australia in 1995.

Document marked D5 filed in an opposition against the corresponding patent in Austria—affidavit asserting that the design elements shown in documents D1-D3 and the description in document D4 relate to a twin-wire press which the affiant observed in Australia on May 12, 2004.

* cited by examiner

*Primary Examiner*—Mark Halpern
(74) *Attorney, Agent, or Firm*—Lerner, David, Littenberg, Krumholz & Mentlik, LLP

(57) ABSTRACT

A frame for a twin-wire press is disclosed including pairs of side members including upper and lower side members arranged on opposite sides of the press, between which upper and lower rolls are attached, a plurality of transverse beams arranged between the pairs of side members which themselves are sections of flat sheet metal and spacers for mutually releasably connecting the side members with the sheet metal being formed so that it permits a degree of curing in the vertical plane to facilitate access to the space between the upper and lower rolls. A method for exchanging wire in a twin-wire press of this type is also disclosed.

4 Claims, 3 Drawing Sheets

TWIN-WIRE PRESS

This application is a 371 of PCT/SE05/00850 filed on 3 Jun. 2005.

FIELD OF THE INVENTION

The present invention relates to a frame for a twin-wire press and a method for exchange of wire in twin-wire press comprising said frame.

BACKGROUND OF THE INVENTION

Twin-wire presses for dewatering of a fiber suspension and forming of a continuous web thereof are previously known. Dewatering of the pulp is usually done from an inlet pulp concentration of 3 to 8 percent by weight to an outlet pulp concentration of 30 to 50 percent by weight. According to the state of the art, such twin-wire presses comprises lower rolls, an endless lower wire running in a path around the lower rolls, upper rolls, and an endless upper wire running in a path around the upper rolls. The two wires co-operate with each other along sections of said paths that run substantially in parallel with each other for dewatering of the fiber suspension between the wires during displacement thereof. An inlet box provides for supply of the fiber suspension to a wedge-shaped dewatering space between the wires. The twin-wire press further comprises two dewatering tables supporting the respective wire in said sections of the path and forming the wedge-shaped dewatering space between the wires for initially pressing and dewatering the fiber suspension, whereby a web is formed between the wires, and a roll arrangement situated after the dewatering tables in said sections of the paths, as seen in the direction of movement of the wires, for finally pressing and dewatering the web between the wires, so that the web will get a desired dryness.

It is often necessary in a simple way and as quickly as possible during maintenance, exchange of wire and cleaning of the twin-wire press, without prolonged stoppage of production, to be able to reach the space between the upper and lower rolls in the roll arrangement. The supporting structure of known twin-wire presses is formed of a framework of longitudinal, parallel arranged, I-beams in the longitudinal direction of the twin-wire press, respectively of transversely parallel arranged I-beams in the transverse direction of the twin-wire press. The transverse and longitudinal beams are firmly fixed, such as welded together, with each other whereby a rigid and stable framework structure is formed. The rolls in these presses are arranged in connection to the longitudinal beams between opposite long sides of the press. In order to be able to reach the space between the upper and lower rolls of the known presses, a hinge joint is arranged along a long side of the press between two longitudinal parallel arranged beams, hereinafter called first longitudinal side member. A space in the longitudinal direction of the press between upper and lower rolls on the opposite long side of the press may then if required be widened by disengaging fixations in the shape of distance elements between longitudinal parallel arranged beams on this opposite side, hereinafter called second longitudinal side member. With the aid of a jack, or the like, arranged to push apart two of the parallel arranged second longitudinal side members between which distance elements have been disengaged, a space between upper and lower rolls can be widen, whereby it is possible to reach the space in the roll arrangement for maintenance, cleaning and exchange of wire.

However, this known structure with a hinge joint is very expensive, complicated and not flexible. Even during production of the twin-wire press a decision has to be taken on which longitudinal side of the press the hinge joint shall be arranged, since that is a question of vital importance for the accessibility to said space between the rolls once the twin-wire press is arranged on the intended position in the paper plant.

One object of the present invention is to achieve an easier, more effective and improved twin-wire press where the space between the upper and lower rolls in the roll arrangement is easily accessible for maintenance, exchange of wire and cleaning if required, and where at least those drawbacks that are associated with previously known state of the art can be partially eliminated. It is another object of the present invention to achieve a twin-wire press that permits an option which long side of the press the space shall be widen between upper and lower rolls for accessibility for maintenance, exchange of wire and cleaning. Yet another object of the present invention is to provide a twin-wire press where maintenance, exchange of wire and cleaning of the press can be carried out cost efficiently and in a work saving way.

SUMMARY OF THE INVENTION

In accordance with the present invention, these and other objects have now been realized by the invention of a frame for a twin-wire press comprising first and second pairs of longitudinal side members, the respective pairs of longitudinal side members comprising an upper side member and a lower side member arranged along each opposite longitudinal side of the twin-wire press, between which first and second pairs of upper and lower rolls are intended to be attached in the twin-wire press, and a plurality of transverse beams arranged between the first and second pairs of longitudinal side members, the respective pairs of the upper and lower side members at least partially comprising sections of flat sheet metal elements, and distance elements for mutually releasably connecting the upper and lower side members, the sheet metal elements being formed such that they permit a predetermined degree of curving in the vertical plane transverse to the horizontal plane which facilitates access to the space between the upper and lower rolls for performing maintenance, exchange of wire or cleaning. In a preferred embodiment of the frame of the present invention, respective pairs of the side members comprise recesses intended for fastening rolls between the first and second pairs of side members.

In accordance with another embodiment of the frame of the present invention, the lower side members comprise a substantially flat sheet metal element.

In accordance with another embodiment of the frame of the present invention, the upper side members comprise a substantially flat sheet metal element.

In accordance with the present invention, a method has also been discovered for the exchange of wire in a twin-wire press including a frame as set forth above in which an endless lower wire runs in a path around the pair of lower rolls and an endless upper wire runs in a path around the pair of upper rolls, the method comprising disengaging the distance elements from the upper and lower side members of one of the pair of side members, pushing apart the upper and lower side members of the one of the pairs of side members by causing the sheet metal element of the other of the pairs of side members to curve to some extent in a vertical plane transverse to the horizontal plane under which the upper and lower side members of the one of the pairs of side members are pushed apart, removing the distance elements to form a free opening between the upper and lower side members of the one of the pair of side members and removing the at least one of the lower and upper wires through the free opening between the upper and lower side members of the one of the second pairs of side members. Preferably, the sheet metal elements of the one of the pairs of side members are curved by means of at least a press apparatus.

These objects are thus achieved with a frame for a twin-wire press according to the present invention. The frame comprises a first and a second pair of longitudinal side members. The respective pairs of side members comprises an upper side member and a lower side member and are arranged along each opposite longitudinal long side of the twin-wire press, between which first and second pair of side members rolls are arranged to be attached in the twin-wire press. Furthermore, the frame comprises several transverse beams arranged between the first and the second pair of opposite side members. The frame includes respective side members that at least partially comprise sections of flat sheet metal elements. Upper and lower side members of the respective pairs of side members are mutually releasably connected by distance elements. The sheet metal element is formed such that it permits a certain extent of curving in a vertical plane, transverse to the horizontal plane, which facilitate accessibility to the space between the upper and lower rolls for performing work with maintenance, exchange of wire and cleaning.

In view of the fact that the longitudinal side members of the frame partially comprise flat sheet metal elements, the requirement of a hinge structure that is necessary in conventional twin-wire presses can be completely eliminated. In order to reach the space between upper and lower rolls along a long side of the press, the sheet metals' own curvature is utilized. By curving the sheet metal of the side members on one of the longitudinal sides of the press, and disengaging the distance elements between the opposite longitudinal side members on the second long side of the press, the upper and lower side members can be brought apart to facilitate access to the space between the upper and lower rolls. The present invention facilitates that work with maintenance, exchange of wire and cleaning of the twin-wire press can be performed efficiently whereby the operation of the press only needs to be interrupted for a shorter period. Thus, a cost saving can be achieved thanks to a shorter time for interruption and an elimination of the conventional hinge structure. Furthermore, the present invention also means that the production and the assembly of the twin-wire press becomes more effective, since apertures of the sheet metal elements of the side members can be cut out already at the production which results in that there will be no matching difficulties at the assembly. Besides, the flat sheet metal elements of the side members can form attachments for assembly of the bearing housing of the rolls, which results in a simplified assembly. Another advantage is that all apertures that are needed in the sheet metal elements can be machined directly in the sheet metal at the production that leads to that there will be exact positions for fastening of rolls and other details.

The present invention also relates to a method for exchange of wire in a twin-wire press comprising a frame as described above, where upper and lower rolls are arranged between the first and second pair of side members. Furthermore, the twin-wire press comprises an endless lower wire running in a path around the lower rolls, and an endless upper wire running in a path around the upper rolls. According to the method of the present invention, the fixation of the distance elements in attachments to the upper and lower side member of the second pair of side members is disengaged; the upper and lower side member of the second pair of side members are pushed apart, by causing the sheet metal elements of the first pair of side members to some extent to curve in a vertical plane, transverse to the horizontal plane, under which the upper and lower side members of the second pair of side members are pushed apart; the distance elements are removed, whereby a free opening is formed between the upper and lower side members of the second pair of side members; and the lower and/or the upper wire is removed through the free opening between the said upper and lower side members of the second pair of side members.

BRIEF DESCRIPTION OF THE DRAWINGS

Additional preferred embodiments according to the present invention are evident from the following detailed description with reference to the accompanying drawings, wherein.

DETAILED DESCRIPTION

Figure 1:
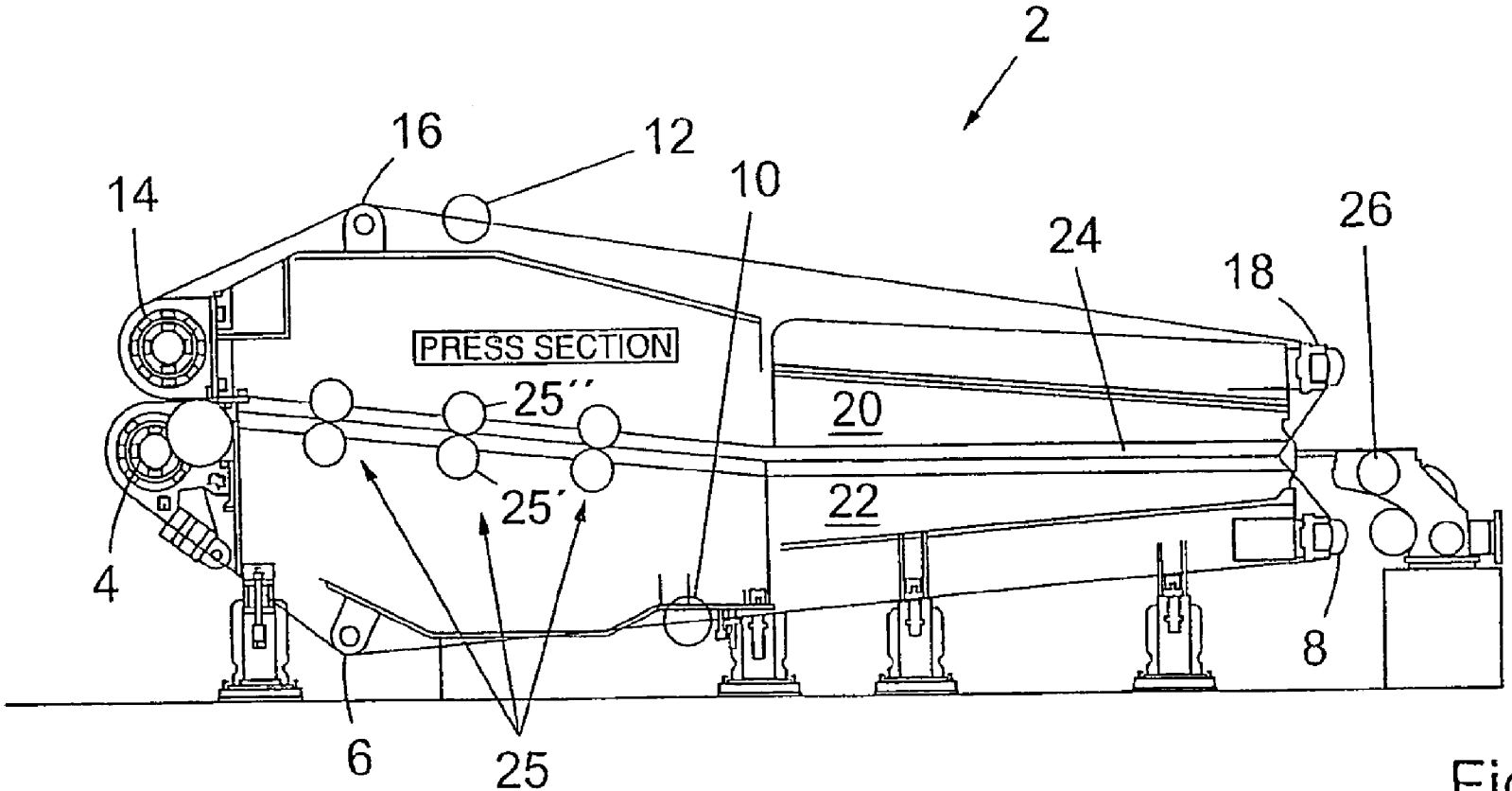
FIG. 1 is a side, elevational, schematic, cross-sectional view through a twin-wire press according to one embodiment of the present invention.

FIG. 1 shows a twin-wire press 2 according to the present invention. The twin-wire press 2 comprises three lower rolls, namely, a drive roll 4, a control roll 6 and a tensioning roll 8. An endless lower wire 10 runs in a path around the lower rolls, 4, 6 and 8. In a corresponding manner an upper endless wire 12 runs in a path around three upper rolls, namely, a drive roll 14, a control roll 16 and a tensioning roll 18. An upper dewatering table 20, that supports the upper wire 12, and a lower dewatering table 22, that supports the lower wire 10, forms the dewatering space 24 between the wires, 10 and 12, in which the fiber suspension/web M is dewatered. "Press section" refers to an ordinary roll arrangement according to the state of the art that can involve a plurality of roll pairs 25, such as schematically shown in FIG. 1. An inlet box 26 is arranged at one end of the press.

Figure 2:
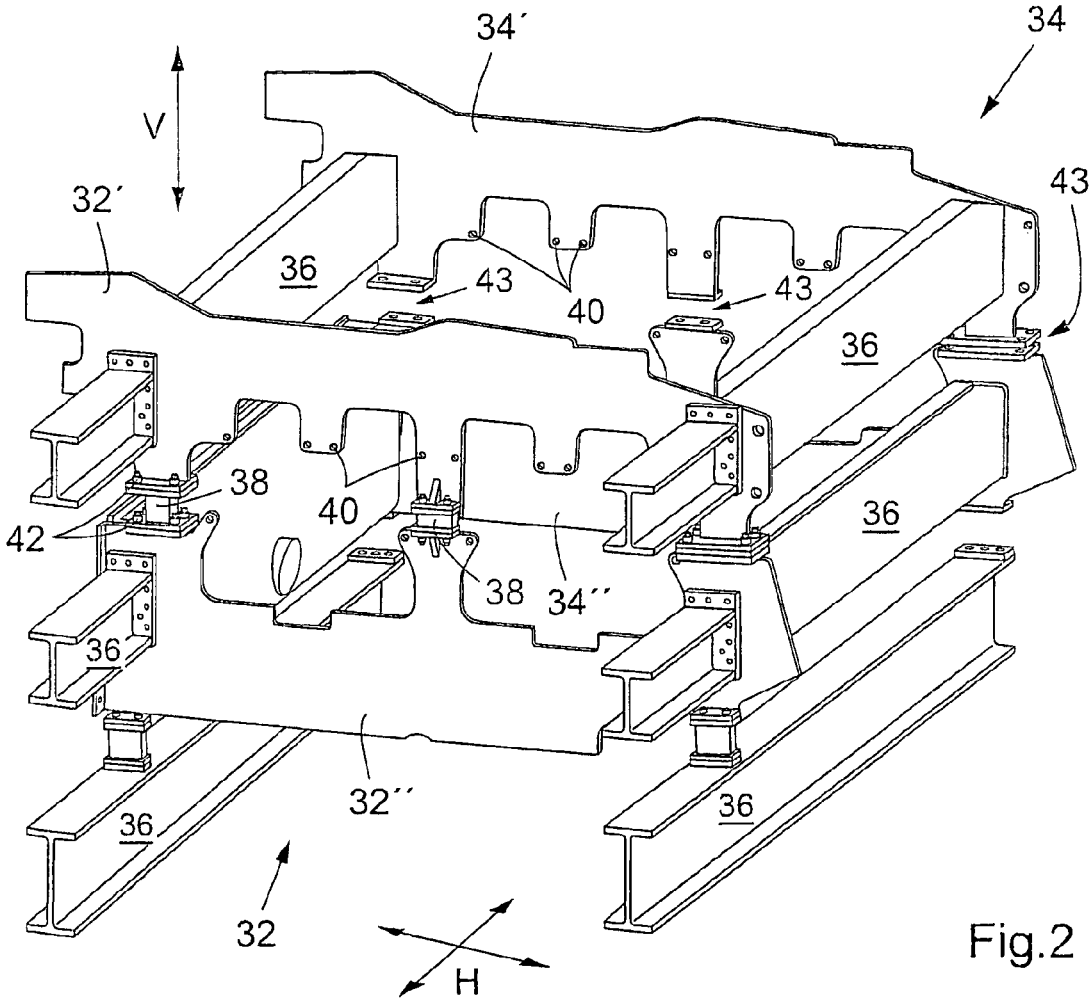
FIG. 2 is a side, perspective, schematic, view of a frame for a twin-wire press according to one embodiment of the present invention.

FIG. 2 shows a frame for a twin-wire press described with reference to FIG. 1, mainly intended as a frame for the roll arrangement of the press. The frame comprises a first and a second pair of longitudinal side members, 32 and 34. The first pair of side members 32 comprises an upper side member 32' and a lower side member 32" arranged along a longitudinal first long side of the twin-wire press. The second pair of side members 34 comprises an upper side member 34' and a lower side member 34" arranged along a longitudinal second long side of the twin-wire press. Between the first 32 and second 34 pair of side members in the twin-wire press are rolls intended to be attached. Furthermore, the frame comprises several firmly fastened transverse beams 36 arranged between the first and second pairs of opposite side members, 32 and 34.

The respective side members, 32', 32", 34', and 34", comprise at least partial sections of flat sheet metal elements. Upper and lower side members, 32' and 32", of the first pair of side members 32, and respective upper 34' and lower side member 34" of the second pair of side members 34, are mutually releasably connected by distance elements 38 (in FIG. 2 are the distance elements of the second pair of side members 34 are removed).

The respective side members, 32', 32", 34', and 34", comprise recesses 40 intended for fastening of rolls between the first and second pair of longitudinal side members, 32 and 34. As shown in the preferred embodiment of the frame in FIG. 2, substantially the whole lower side members, 32"πand 34", respectively substantially the whole upper side members 32' and 34', can comprise flat sheet metal elements. However, the whole side members need not be comprised of flat sheet metal elements according to the most general embodiment, but it is sufficient first of all that the side members at least partially comprises sections of flat sheet metal elements. In that respect, at least those sections of the side members that are adjacent to the distance elements suitably comprises flat sheet metal elements. Preferably, those sections of the side members that are adjacent to the fastening of the rolls to the side members can comprise flat sheet metal elements. The sheet metal elements, and thus the sections of the side members that comprises sheet metal elements, are formed such that, to certain extent, they permit a curving in a vertical plane V, transverse to the horizontal plane H.

At the time of an exchange of wire in a twin-wire press 2 (see FIG. 1) comprising the frame according to FIG. 2, which press comprises upper and lower rolls (see FIG. 1; 25', 25") and an upper and lower wire (FIG. 1), the following stages are performed in the given sequence: 1) The fixation of the distance elements 38 in attachments 42 to the upper 34' and lower 34" side member of the second pair of side members 34 are disengaged by removing those screws by which the distance elements are fixed to the attachment 42. 2) The upper 34' and lower 34', side member of the second pair of side members 34 are pushed apart. The upper side member 34' is transferred in a direction away from the lower side member 34" of the second pair of side members by causing the sheet metal elements of the first pair of side members 32 to curve to some extent in a vertical plane V, transverse to the horizontal plane H under which the upper 34' and lower 34" side member of the second pair of side members are pushed apart. For this purpose a press apparatus is suitably arranged between transverse beams that are adjacent to the first pair of side members. The sheet metal elements of the first pair of side members 32 are curved by means of the press apparatus whereby consequently the upper 34' and lower 34" side member of the second pair of side members 34 is pushed apart in order to be able to disengage the distance elements. 3) The distance elements 38 are removed, whereby a free opening 43 is formed between the upper 34' and lower 34" side members of the second pair 34 of side members. FIG. 2 shows the frame after the distance elements at the second pair of side members have been removed. 4) Possibly the upper 34' and lower 34" side member of the second pair of side members 34 are brought further apart in order to create a larger free opening 43. The lower and/or the upper wire are removed through the free opening 43 between the said upper 34' and lower 34" side members of the second pair 34 of side members.

Figure 3:
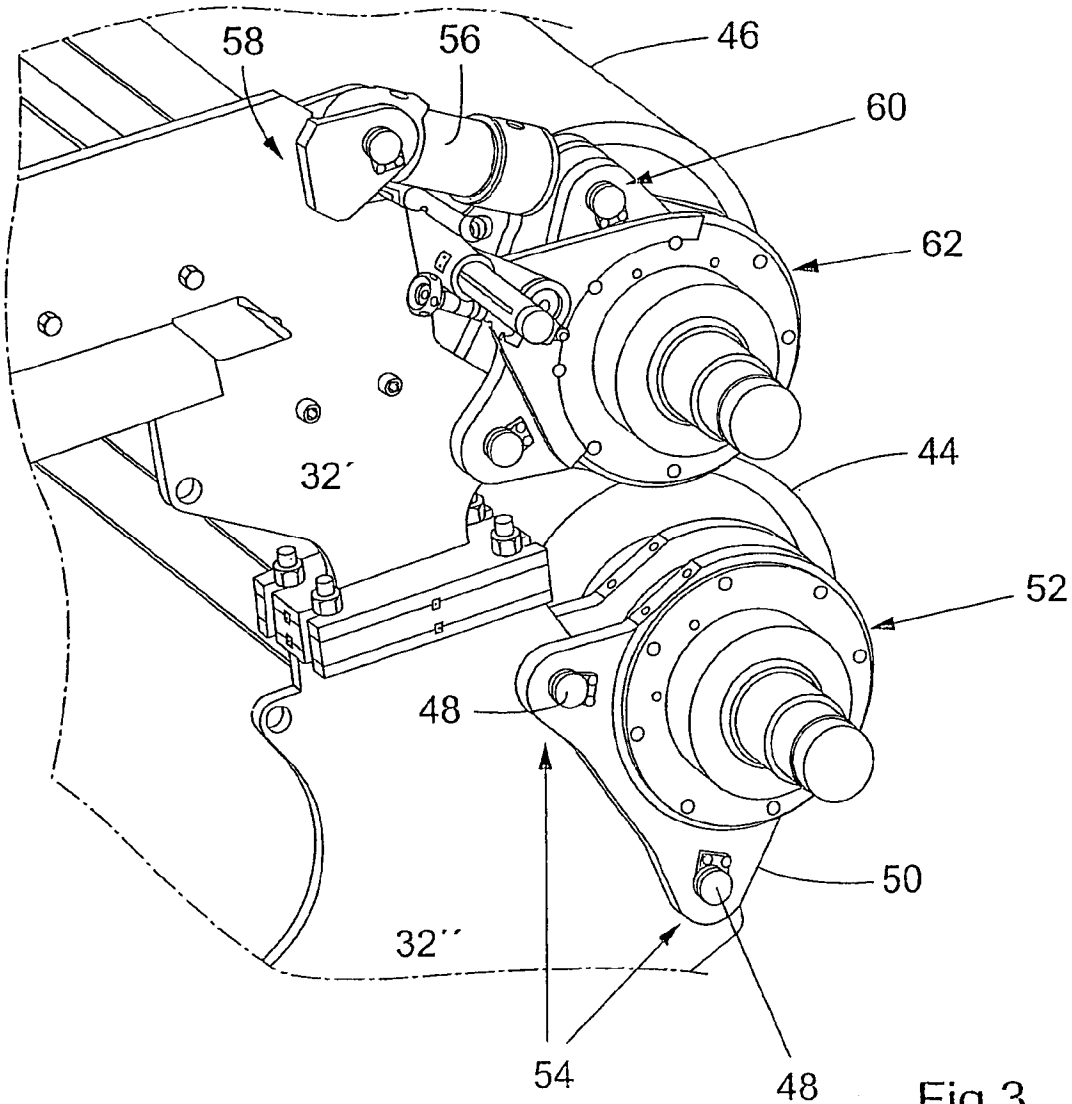
FIG. 3 is a front, partial, perspective, schematic view of a fastening of a bearing housing of rolls in a frame according to FIG. 2.

With reference to FIG. 3, fastening of a lower roll 44 and an upper roll 46 to a flat section of a sheet metal element of the upper and lower side members, 32' and 32", respectively, of the first pair of side members 32 in FIG. 2, is shown according to a preferred embodiment. By means of attachments 48 such as pins, bolts or the similar, a projecting section 50 of a bearing housing 52 of the lower roll 44 is fixed to the flat sheet metal element section 54 of the lower side member 32". In FIG. 3 is also shown the fastening of a hydraulic cylinder 56 between a flat sheet metal element section 58 of the upper side member 32' and a projecting section 60 at a bearing housing 62 of the upper roll 46. By this arrangement of the bearing housing 52, 62 of the rolls to the frame according to the present invention, a more effective and uncomplicated fastening of the rolls is achieved in comparison to what has been possible in the conventional existing frameworks in the previously known twin-wire presses.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A frame for a twin-wire press, comprising first and second pairs of longitudinal side members, each of said first and second pairs of longitudinal side members comprising an upper side member and a lower side member arranged along the opposite longitudinal sides of said twin-wire press, said first and second pairs of longitudinal side members including a mounting portion for first and second pairs of upper and lower rolls, and a plurality of transverse beams arranged between said first and second pairs of longitudinal side members for supporting said frame, said first and second pairs of said upper and lower side members comprising flat sheet metal portions, and distance elements releasably connected to said upper and lower side members, whereby upon release of said distance elements from connecting said upper and lower side members said upper and lower side members permit a predetermined degree of curving in a vertical plane, transverse to the horizontal plane, which facilitate access to the space between said upper and lower rolls for performing maintenance, exchange of wire and cleaning.

2. A frame according to claim 1, wherein each of said first and second pairs of said longitudinal side members comprise recesses intended for fastening rolls between said first and second pairs of longitudinal side members.

3. A frame according to claim 1, wherein said substantially the entire surface of lower side members comprise a flat sheet metal element.

4. A frame according to claim 1, wherein substantially the entire surface of said upper side members comprise a flat sheet metal element.

* * * * *